US005361114A

United States Patent [19]

Earle

[11] Patent Number: 5,361,114

[45] Date of Patent: Nov. 1, 1994

[54] PHOTOGRAPHIC PROCESSING TANK

[75] Inventor: Anthony Earle, Middlesex, United Kingdom

[73] Assignee: Eastman Kodak Company, Rochester, N.Y.

[21] Appl. No.: 956,017

[22] PCT Filed: May 30, 1991

[86] PCT No.: PCT/EP91/01005

§ 371 Date: Dec. 4, 1992

§ 102(e) Date: Dec. 4, 1992

[87] PCT Pub. No.: WO91/19226

PCT Pub. Date: Dec. 12, 1991

[30] Foreign Application Priority Data

Jun. 8, 1990 [GB] United Kingdom ..... 9012860

[51] Int. Cl.[5] ..... G03D 3/08

[52] U.S. Cl. ..... 354/320; 354/321; 354/323; 354/331; 354/336

[58] Field of Search ..... 354/317–324, 354/331, 336; 29/129.5, 132, 123; 134/122 P, 64 P

[56] References Cited

U.S. PATENT DOCUMENTS

| | | | |
|---|---|---|---|
| 717,021 | 12/1902 | Pollak | 354/319 |
| 2,538,270 | 1/1951 | Pratt et al. . | |
| 3,057,282 | 10/1962 | Luboshez . | |
| 3,435,749 | 4/1969 | Cauwe et al. . | |
| 3,598,037 | 8/1971 | Houston . | |
| 3,601,029 | 8/1971 | Needleman . | |
| 3,952,610 | 4/1976 | Hope et al. . | |
| 4,166,688 | 9/1979 | Sachs | 354/319 |
| 4,461,555 | 7/1984 | Kuzyk et al. | 355/323 X |
| 4,512,645 | 4/1985 | Engelhardt et al. | 354/324 |
| 4,736,222 | 4/1988 | Stromberg | 354/324 |
| 4,745,423 | 5/1988 | Uchida | 354/320 |
| 4,947,199 | 8/1990 | Tsunekawa | 355/322 |
| 4,987,438 | 1/1991 | Goto et al. | 354/319 |
| 4,993,133 | 2/1991 | Goeserich | 29/129.5 |
| 5,287,139 | 2/1994 | Inoue | 354/320 |

FOREIGN PATENT DOCUMENTS

| | | |
|---|---|---|
| 3230175A1 | 5/1983 | Germany . |
| 491479 | 9/1988 | United Kingdom . |

OTHER PUBLICATIONS

Patent Abstract of Japan, vol. 13, No. 488 (P-954) (3836), Nov. 7, 1989.

Patent Abstract of Japan, vol. 14, No. 141 (P-1023) (4084), Mar. 16, 1990.

*Primary Examiner*—D. Rutledge

*Attorney, Agent, or Firm*—Nixon, Hargrave, Devans & Doyle

[57] ABSTRACT

A low volume photographic processing tank for use in photographic processing apparatus as a low volume path for solution treating material being processed and drive rollers in the path of the tank driving material through the path. The rollers have external drives. The whole tank is able to be withdrawn and replaced from the apparatus for servicing and repair.

12 Claims, 4 Drawing Sheets

PHOTOGRAPHIC PROCESSING TANK

FIELD OF THE INVENTION

This invention relates to a photographic processing tank for use in a photographic processing apparatus of the kind in which an imagewise photographic material is processed by passing it serially through a plurality of tanks containing photographic processing solution.

BACKGROUND OF THE INVENTION

The invention is particularly concerned with processing tanks which are of the low volume type. A low volume or thin volume tank is particularly useful in photographic processing apparatus since imagewise exposed material which is being processed is passed along a path of very narrow dimensions which is filled with a processing liquid. Many of the liquids used are unstable and therefore have to be used very swiftly. If a conventional tank of processing solution is used and material being processed is not passed through it continuously, after a short period the whole tank of solution will have to be disposed of and fresh solution inserted for processing of the next batch of imagewise material. This can be extremely expensive since the solution is not being used to its maximum effect and can also give rise to other problems as the solution which is discarded will have to be treated before it can be environmentally acceptable and the treatment of large quantities of liquid becomes in itself a problem and expensive.

The principle of using a low volume tank has been known for some time and in U.S. Pat. No. 717,021 a narrow passage is disclosed which is defined between two blocks of material and photographic material to be processed is passed from external rollers through this narrow passage and is immersed in solution contained in the passage. The solution is constantly topped up by an automatic feed reservoir which feeds solution into the bottom of the passage. One of the problems arising from this type of narrow passage treatment is that the material being processed has to be pushed through by the feed rollers at the entrance to the narrow passage. Generally as the material is processed in the solution its physical nature changes and it becomes soft and clearly cannot be pushed very well over a long passage.

It has been suggested, for example in U.S. Pat. No. 4,736,222, that a leader should be attached to the material being processed. In this patent specification two strips of film are connected to a leader and the leader itself has central apertures which are engaged by drive sprockets of a timing chain in a tank. The leader pulls the film through the solution in the tank, round the bottom roller and out of the tank. The whole drive mechanism is basically immersed in the solution of the tank and this may cause corrosion with subsequent jamming or breakage of the drive mechanism and chemical contamination of the solution. Other prior art arrangements are described in GB-A-491479 and DE-A-3230175.

The disadvantages thus arise with the use of these known thin volume of processing apparatus that if an occurrence such as the material being processed jams in the tank, the whole of the process has to be interrupted for a substantial period while the whole of the apparatus is drained and taken apart to remove the blockage and then reassembled. Furthermore, by the inclusion of the drive mechanism within the solution, problems arising from corrosion are likely to give more frequent need for the machine to be taken to pieces for cleaning and replacement of parts. Also, as the drive passes through the solution surface it picks up solution and agitates the surface, this gives rise to increased chemical degradation by oxidisation, increased losses by evaporation and precipitation of hard crystals which could physically damage film. This down-time and solution wastage can be very expensive in modern processing commercial operations where it is necessary to ensure a steady and continuous throughput of material being processed in order to maximise the capital costs of the equipment.

It is an object of the present invention, therefore, to provide a photographic processing tank for use in low volume processing apparatus which reduces the risk of corrosion oxidisation and precipitation occurring and which enables any problems arising from jamming of the material or any other problem with the tank swiftly to be dealt with without causing a long delay in the photographic process thereby substantially minimising the down-time of the apparatus.

SUMMARY OF THE INVENTION

In order to achieve this there is provided according to the invention a photographic processing tank for use in a photographic processing apparatus of the kind in which imagewise photographic material is processed by passing it serially through a plurality of tanks containing photographic processing solutions at least one of the tanks being of the low volume type the or each low volume tank (10) being configured to define a low volume path (9) along which the material to be treated can pass and transporting means (10, 11, 12, 13) for moving the material along said path characterised in that the transporting means comprises rollers (10, 11, 12, 13) carried between opposite walls of the tank (10) and disposed so that they extend into the low volume path to contact the material to move it along said path, said rollers including shaft means extending in a sealing tight manner through a said wall so that they can be coupled to drive means external to the tank (10).

The roller means may comprise a pair of rollers positioned to receive the material between the nip of the rollers and to progress it along the path. One of these rollers may be of a shorter length than the other roller. Idler rollers may be incorporated into the body of the tank to provide a nip with a corresponding drive roller.

The shaft means can include rotating means attached to the projecting part of the shaft. The rotating means may be a sprocket adapted to be driven by a drive chain or the like, or may be a gear wheel intermeshing with a mating gear wheel of a prime mover.

Alternatively, the rotating means may include magnetic coupling means for magnetically connecting the shaft with a prime mover positioned adjacent the tank.

Fluid seals are preferably incorporated in the walls of the tank where the drive shaft connects therethrough.

The drive means may further include rollers positioned at the inlet or the outlet of the low volume path for the tank or at both positions.

The tank may include a turnaround roller at a point where material being processed is caused to change direction. These may be a plurality of modular sections for the tank, one section including the said turnaround roller and the other sections being turnaround roller and the other sections being disposed to align the low volume path in each section to form a continuous low volume path. Sealing may be included between the sections.

In order that the invention may be readily understood, two examples of photographic processing tank, suitable for photographic processing apparatus including a plurality of tanks through which imagewise photographic material to be processed is passed will now be described by way of example only with reference to the four figures of the accompanying drawings.

BRIEF DESCRIPTION OF THE DRAWINGS

In the drawings:

FIG. 3 is a side view of a turnaround module of a tank showing the bottom side arrangement, while

DETAILED DESCRIPTION

Figure 1:
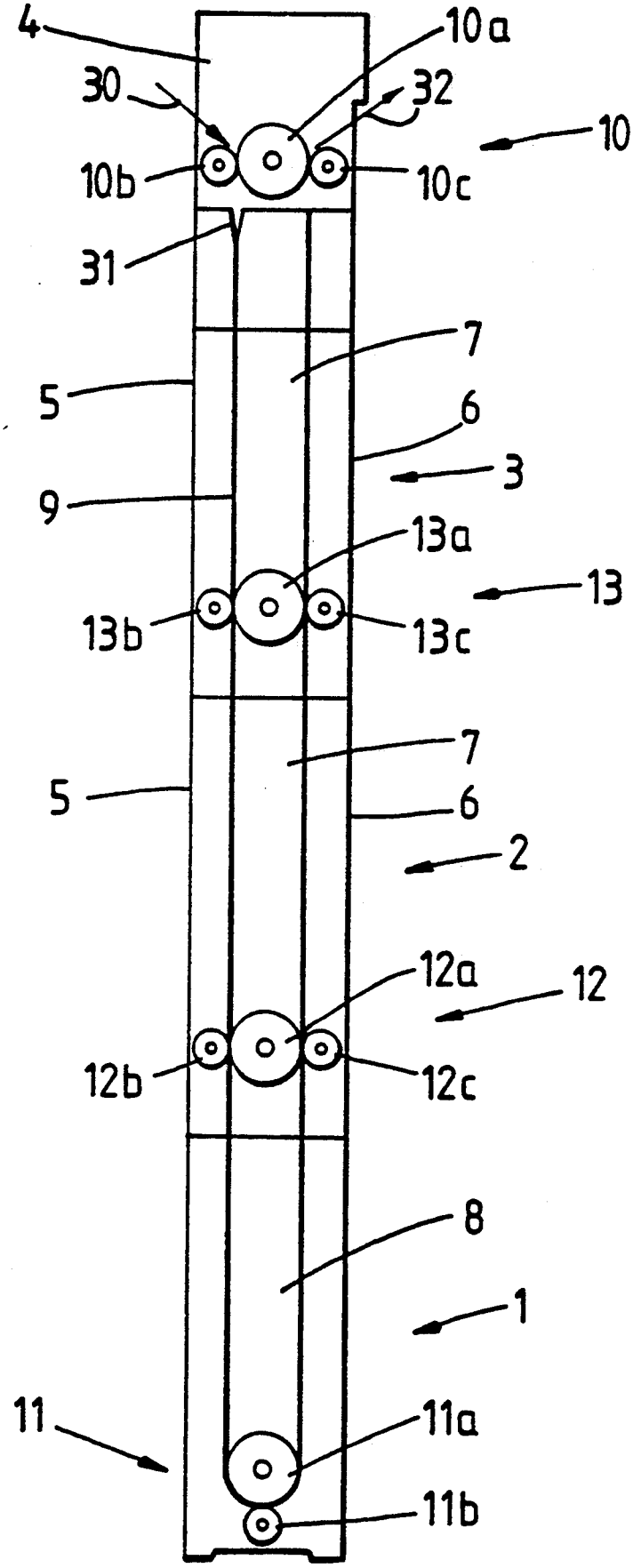
FIG. 1 is a sectional end view through a multi-modular tank of the invention.

Referring first to FIG. 1 of the drawings, the tank shown here is a multi-modular tank made up of four basic modules: a turnaround module 1, two intermediate modules 2, 3 and a head module 4. The modules 1,2,3 each comprise two side walls 5,6 having a central portion 7 for modules 2,3 and a portion 8 for module 1 positioned between these and separated by a small gap which forms a continuous low volume path 9, for the material to be processed. This path is very low volume and is as described and claimed in our co-pending International application No. EP91/00785.

As shown in FIG. 1, there are provided four sets of drive rollers for the material to be processed. These comprise a first set 10 fixed between end plates at the top of the tank, a bottom set 11 at the trough of the turnaround module 1 and two intermediary sets 12 and 13 in the intermediate modules 2,3. Each set of rollers 10,12,13 comprises a central roller a and two side rollers b,c. The set of rollers 11 are constituted by a large diameter roller 11*a* and a smaller diameter inlet roller 11*b*. The central rollers a extend the width of the tank and the side rollers are of a shorter length. The material to be fed into the tank is fed to the nip between these rollers 10*a* and 10*b*. The third roller 10*c* of the set is disposed at the outlet of the tank and draws material being processed out from the path formed by gap 9 in the nip between rollers 10*a* and 10*c*.

Central rollers 12*a* and 13*a* of the sets 12 and 13 respectively are positioned in the central portion 7 of modules 2 and 3 with their peripheries extending into the path 9. Corresponding side rollers 12*b*, 12*c* and 13*b*, 13*c* are set in recesses in the side walls 5 and 6 respectively and their peripheries extend also into the path 9 to form a nip with the respective central roller 12*a* or 13*a*.

At the bottom of the tank in the turnaround module the set of rollers 11 comprises only two rollers, a large diameter roller 11*a* set at the foot of the central portion 8 and forming a nip with the smaller roller 11*b* centrally positioned at the base of the tank.

Figure 3:
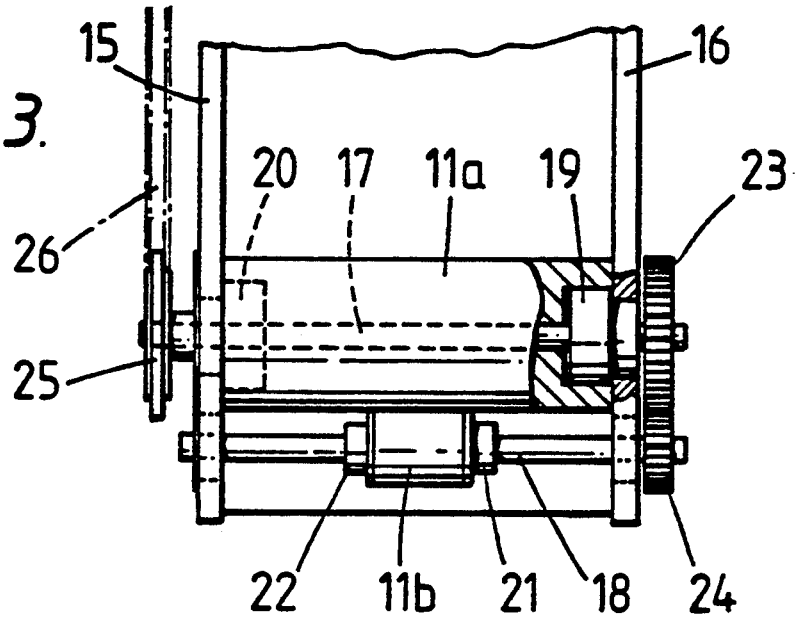
Figure 4:
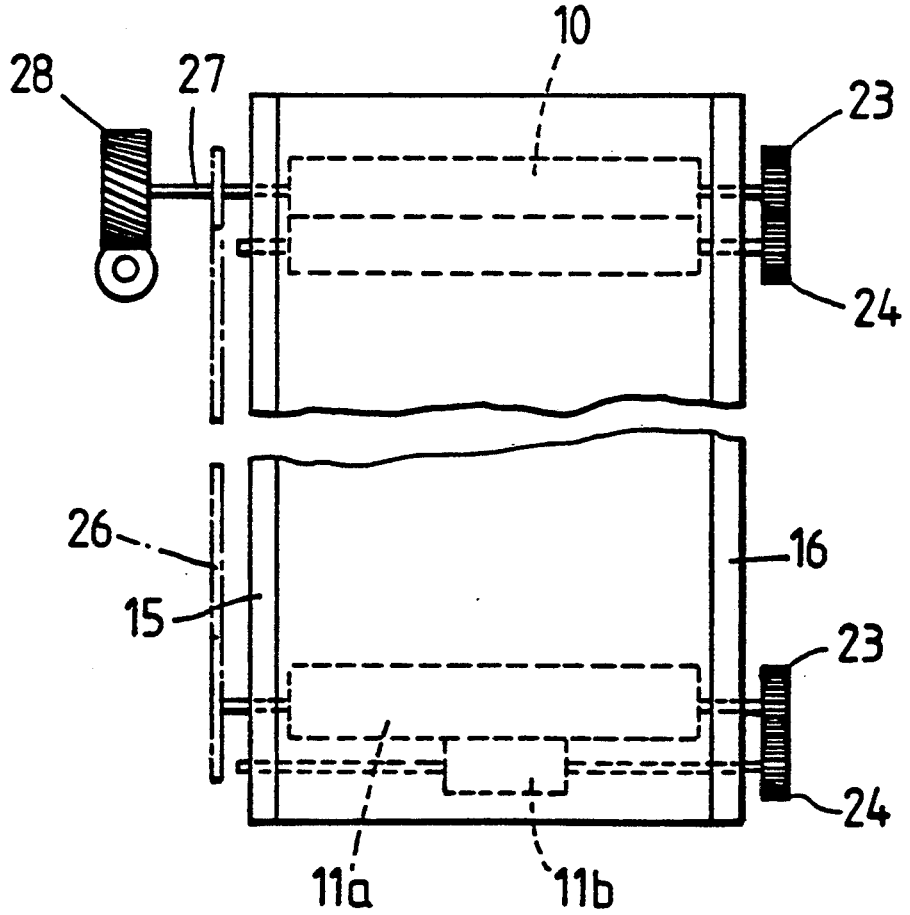
FIG. 4 is an end view of a tank indicating one form of drive arrangement.

The rollers are all mounted on rotatable axles which extend through the side plates 15,16, as is particularly illustrated in the view of FIGS. 3 and 4. Appropriate leak-proof seals are provided in respect of each of the shafts. For example shafts 17 and 18 of the turnaround module 1 rollers 11*a*, 11*b* are shown in FIG. 3 where the seals are indicated by references 19, 20, 21 and 22. These seals enable the shaft to rotate freely but do not allow any liquid from inside the tank to egress to the outside of the tank. The material of the seals is chosen so as to be a non-grease bearing seal and to be self-lubricating. The material of the seals must of course be selected with attention to the type of liquid to be inserted into the tank to ensure that this material does not react with the liquid of the processing solution.

Figure 2:
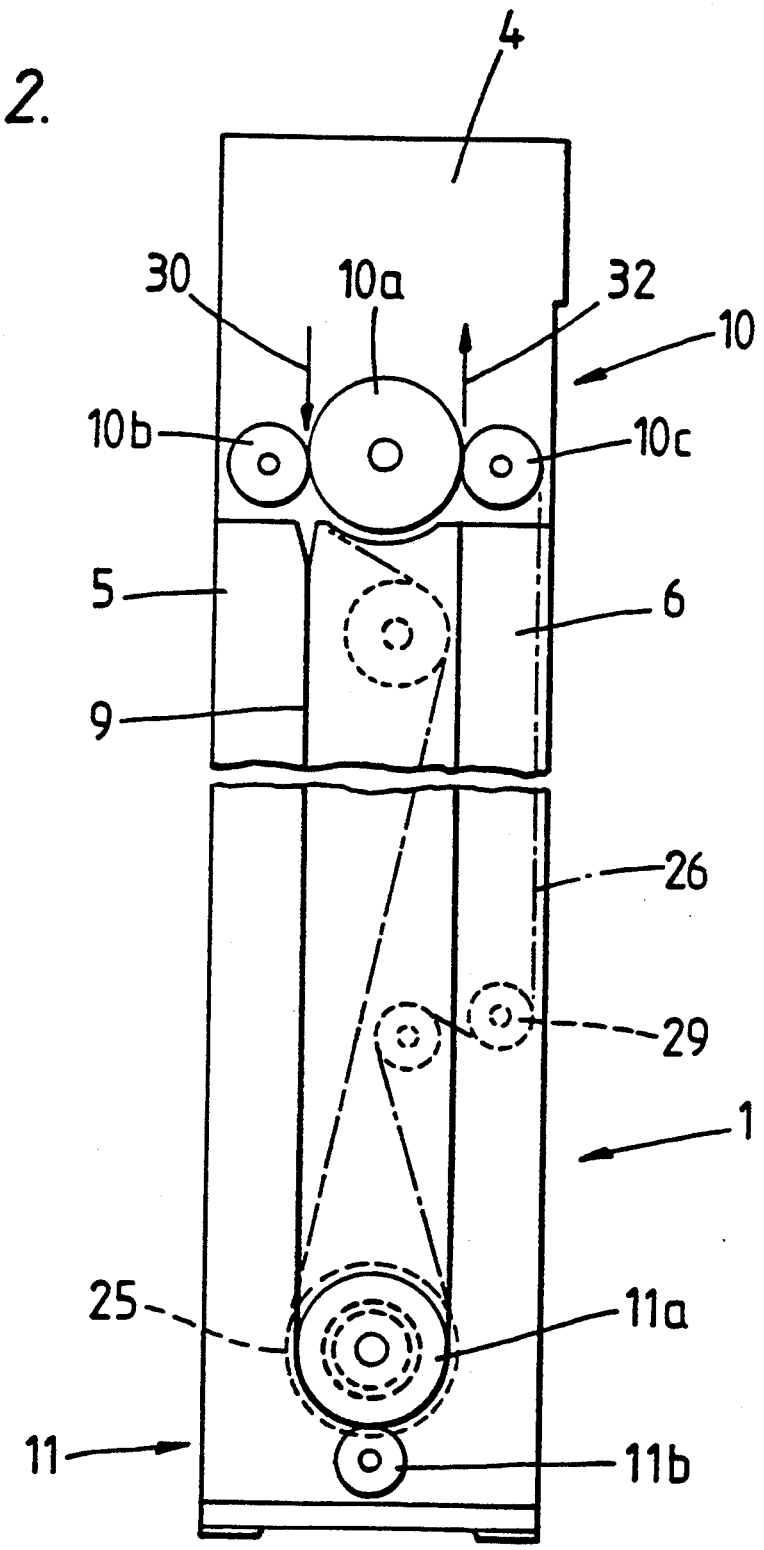
FIG. 2 is an end view of a single module tank of the invention.

In this example, each of the sets of rollers are arranged so that on one side the axles 17, 18 terminate in intermeshing gears 23, 24 and on the other side the central roller axle 17 carries a drive sprocket 25 which can be engaged by a drive chain 26 (FIGS. 2 and 4).

Referring particularly to FIG. 4, it can be seen that the drive in this Figure for the chain 26 is via a shaft 27 to a worm and wheel gear 28 which is driven from a prime mover (not shown), in this case an electric motor. The chain may be tensioned, for example by a tension roller 29, as shown in FIG. 2.

In operation photographic material to be processed, in this case exposed photographic material, is fed into the tank between the rollers 10*a* and 10*b* in the direction of the arrow 30 (FIGS. 1 and 2). The paper enters a funnel area 31 at the beginning of the path 9 and the rollers 10*a* and 10*b* drive the leading edge of the material along the path until it is picked up in the set of rollers 13 between the rollers 13*a* and 13*b*. The paper is then passed further along the path until it reaches through rollers 12 the bottom set of rollers 11 where it terminates its downward direction and is driven around roller 11 between 11*a* and 11*b* and in an upwards direction to be picked up between the nip of rollers 12*b* and 12*c*. It is then fed up to rollers of set 13 and to the exit from the tank via rollers 10*a* and 10*c*, where it comes out in the direction of arrow 32.

The whole of the path 9 is filled with a processing solution which may be a developer, amplifier, wash solution or a fixing solution as appropriate to the stage of the process in which this particular tank forms part. There will be a number of tanks of this nature and when the material comes out at 32 it can then be fed into a similar tank immediately adjacent to the tank through which it has just passed but containing a different solution.

All the rollers in the sets 10, 11, 12 and 13 are driven at the same speed through the worm and wheel drive 28, shaft 27 and drive chain 26 so that there is a constant tension on the material as it is progressed through the path 9. The duration of the material in the solution in the path 9 can be controlled by suitable control of the speed of the drive but normally duration is fixed by the machine manufacturer and the type of process being used.

The solution in the path 9 is kept at a constant level since funnel 31 acts as a form of reservoir and fresh solution can be constantly fed through the reservoir.

The tank as described has the advantage that being of a very low volume only a small volume of solution is required in the processing of the material. If any fault occurs with the material and, for example, it becomes jammed within the path 9 it is a relatively simple job to remove the tank from the whole of the processing apparatus of which it forms part, merely by lifting out the modules. Only the gear 28 of the drive has to be disengaged from the prime mover. The tank can thus be readily lifted out and a replacement tank can be inserted and no elaborate connecting and disconnecting procedures have to be gone through. As soon as the new tank is filled with solution the whole of the processing apparatus is able to be restarted with a minimum of delay in the processing operation.

Once withdrawn the tank in which the fault has occurred can then be removed for investigation and repair. If in a multi-module tank the modules have to be separated they can easily be later reassembled with the inclusion of suitable sealing membrane between them which does not react with the chemicals used.

Due to the nature of the rollers and the fact that the drive to them is external to the tank there is very little likelihood of the drive mechanism giving any problems. However, if solution has spilt onto the drive mechanism from elsewhere in the apparatus and causes corrosion, it is again easy to replace the tank while the corroded part is replaced.

It will be appreciated that the tank is provided with suitable guides or slides in the apparatus so that it is correctly positioned when it is replaced.

The specific examples that have been described can be varied in a number of ways. Particularly, for example, the drive may not be through the gear drive 28 as illustrated, but there may be a continuous chain drive in the body of the apparatus and when the tank 1 is inserted into the apparatus the gear 28 engages with the chain drive and the chain acts as a rack and pinion drive for the rollers.

Figure 5:
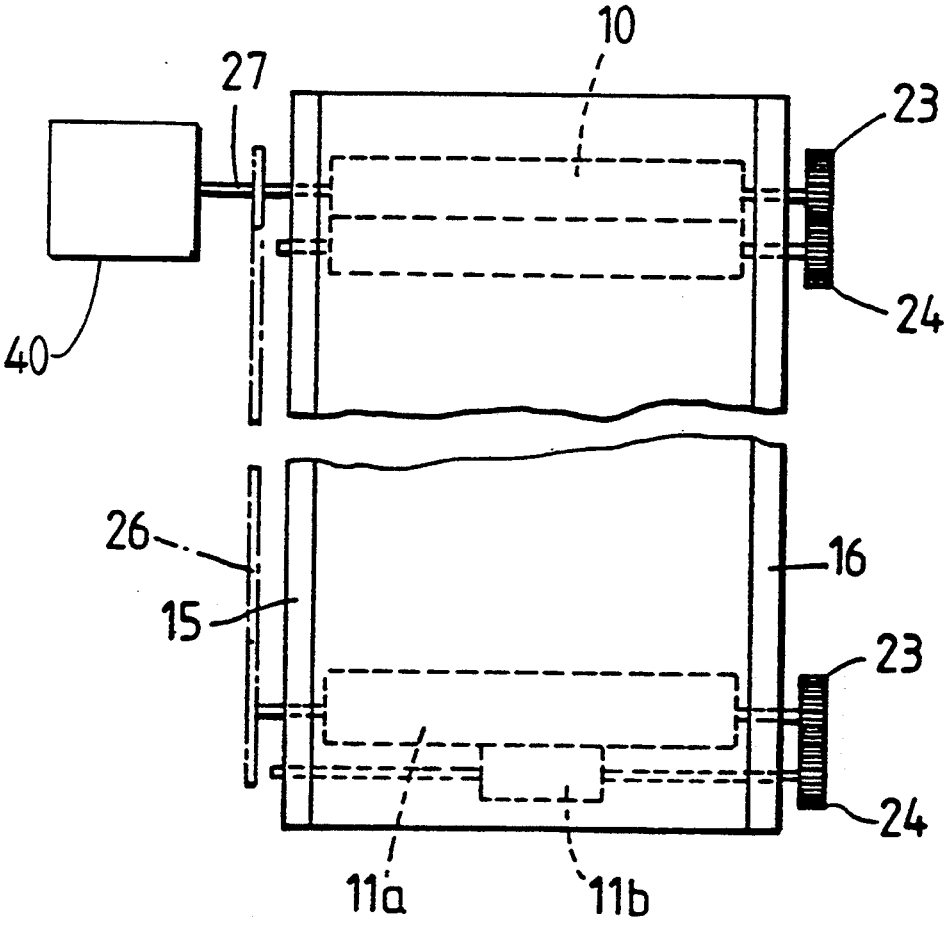
FIG. 5 is an end view of a tank including an electromagnetic drive arrangement.

A further alternative drive may be to use, with the prime mover, an electromagnetic coupling means 40 such that there is no physical contact between the prime mover and a drive element carried on the shaft 27 as shown in FIG. 5. This may be particularly advantageous where it is desired to keep the number of intermeshing parts to a minimum.

Other variations and alterations to the tank will be possible without departing from the scope of the invention.

I claim:

1. A photographic processing tank for use in a photographic processing apparatus of the kind in which imagewise photographic material is processed by passing it serially through a plurality of tanks containing photographic processing solutions at least one of the tanks being of the low volume type, each low volume tank comprising at least two separable modular sections and being configured to define a low volume path along which the material to be treated can pass and transporting means for moving the material along said path characterized in that the transporting means comprises rollers carried between opposite walls of the tank and disposed so that they extend into the low volume path to contact the material to move it along said path, said rollers including shaft means extending in a sealing tight manner through said walls so that they can be coupled to drive means external to the tank.

2. A tank as claimed in claim 1 characterised in that the roller means includes a pair of rollers set in the tank on either side of the low volume path and positioned to receive material being processed between the nip of the rollers and to progress it along the path.

3. A tank as claimed in claim 2 characterised in that one of the rollers is an idler roller.

4. A tank as claimed in claim 2 characterised in that one of the rollers is of a shorter length than the other rollers.

5. A tank as claimed in claim 1 characterised in that each shaft means includes rotating means in the form of a sprocket adapted to be engaged by a drive chain.

6. A tank as claimed in claim 1 characterised in that each shaft means includes rotating means in the form of a magnetic coupling means for magnetically connecting the shaft means with a prime mover positioned adjacent to the tank.

7. A tank as claimed in claim 1 characterised by including drive means at the inlet and outlet of the tank.

8. A tank as claimed in claim 1 characterised in that the tank includes a turnaround roller at a point in the tank where the material being processed is caused to change direction.

9. A tank as claimed in claim 8 characterised by including a plurality of modular sections for the tank one section including the said turnaround roller and the other sections being disposed to align the low volume paths in each section to form a continuous low volume path.

10. A tank as claimed in claim 9 characterised by including sealing means between the sections.

11. The tank as claimed in claim 1 characterized by including seals in the walls of the through which the drive means project.

12. A photographic processing tank for use in a photographic processing apparatus of the kind in which imagewise photographic material is processed by passing it serially through a plurality of tanks containing photographic processing solutions at least one of the tanks being of the low volume type, each low volume tank being configured to define a low volume path along which the material to be treated can pass and transporting means for moving the material along said path characterized in that the transporting means comprises rollers carried between opposite walls of the tank and disposed so that they extend into the low volume path to contact the material to move it along said path, said rollers including shaft means extending in a sealing tight manner through said walls so that they can be coupled to drive means external to the tank and further characterized by including seals in the wall of the tank through which the drive shaft means project characterized in that each shaft means includes rotating means in the form of a magnetic coupling means for magnetically connecting the shaft with a prime mover positioned adjacent to the tank.

* * * * *